US005449121A

United States Patent [19]

El-Darazi et al.

[11] Patent Number: 5,449,121

[45] Date of Patent: Sep. 12, 1995

[54] THIN-WALLED VALVE-CLOSED-ORIFICE SPRAY TIP FOR FUEL INJECTION NOZZLE

[75] Inventors: Denis A. El-Darazi, Peoria; Alan R. Stockner, Metamora, both of Ill.

[73] Assignee: Caterpillar Inc., Peoria, Ill.

[21] Appl. No.: 23,662

[22] Filed: Feb. 26, 1993

[51] Int. Cl.[6] ..... F02M 47/00; F02M 61/18

[52] U.S. Cl. ..... 239/533.3; 239/533.12

[58] Field of Search ..... 239/533.2–533.12

[56] References Cited

U.S. PATENT DOCUMENTS

| | | | |
|---|---|---|---|
| 3,391,871 | 7/1968 | Fleischer et al. | 239/533 |
| 4,083,498 | 4/1978 | Cavanagh | 239/533.3 |
| 4,506,833 | 3/1985 | Yoneda et al. | 239/533.4 |
| 4,527,738 | 7/1985 | Martin | 239/90 |
| 4,540,126 | 9/1985 | Yoneda et al. | 239/533.4 |
| 4,715,541 | 12/1987 | Freudenschuss et al. | 239/533.4 |
| 4,765,543 | 8/1988 | Jaksa et al. | 239/533.2 |
| 5,016,820 | 5/1991 | Gaskell | 239/533.12 |
| 5,037,031 | 8/1991 | Campbell et al. | 239/533.3 |
| 5,092,039 | 3/1992 | Gaskell | 29/890.142 |
| 5,121,730 | 6/1992 | Ausman et al. | 123/467 |

FOREIGN PATENT DOCUMENTS

| | | | |
|---|---|---|---|
| 0116864 | 8/1994 | European Pat. Off. . | |
| 2223270 | 4/1990 | United Kingdom | 239/533.12 |

OTHER PUBLICATIONS

ASME Paper by K. -J. Wu et al Entitled "Measurements of the Spray Angle of Atomizing Jets From Trans. of the ASME", vol. 150 DTD 12/83.

SAE Paper No. 840275 by Arai, et al DTD 1984 Entitled "Disintegrating Process and Spray Char. of Fuel Jet Injected by a Diesel Nozzle".

SAE Paper No. 830448 by K. S. Varde et al Dated 1983 Entitled "Diesel Fuel Spray Penetration at High Injection Pressures".

*Primary Examiner*—Karen B. Merritt

*Attorney, Agent, or Firm*—Anthony N. Woloch; Mark D. Becker

[57] ABSTRACT

A valve-closed-orifice (VCO) spray tip having an internal tip seat and one or more fuel spray orifices. The thickness of the tip in the wall portion defining the internal tip seat and upstream entrance of each orifice is made less than that of previously known VCO tips. The length to diameter ratio of each orifice is also relatively smaller than that of previously known VCO tips. Advantages of the thinner wall portion include improved fuel injection spray characteristics as well as reduced cost of forming orifices through the tip.

2 Claims, 5 Drawing Sheets

THIN-WALLED VALVE-CLOSED-ORIFICE SPRAY TIP FOR FUEL INJECTION NOZZLE

TECHNICAL FIELD

The present invention relates generally to fuel injectors and, more particularly to spray tips for injection nozzles.

BACKGROUND ART

Closed type inwardly-opening fuel injection nozzle assemblies typically include a hollow spray tip or housing and a flow check positioned in the tip. The tip has one or more fuel spray orifices and an internal tip seat upon which the movable check selectively seats.

One category of such nozzle assemblies, known as sac-type nozzle assemblies, generally describes a tip configuration wherein the orifices are located through a sac projecting from the apex of the tip. Thus, in a sac-type tip, the orifices are remotely spaced from the tip seat such that the check does not cover, or even partially cover, the upstream entrances of the orifices when the check is seated on the tip seat. Examples of known sac-type nozzle assemblies are shown in U.S. Pat. No. 3,391,871 issued to Fleischer et al. on Jul. 9, 1968 and U.S. Pat. No. 4,527,738 issued to Martin on Jul. 9, 1985. Sac-type nozzle assemblies having a relatively small sac volume are known as mini-sac nozzle assemblies. An example of a mini-sac nozzle assembly is shown in U.S. Pat. No. 5,037,031 issued to Campbell et al. on Aug. 6, 1991.

Typically, the sac of a sac-type tip has a wall thickness in the range of about 0.60 to 0.80 mm or millimeters (about 0.024 to 0.031 inches) in the region where the orifices pass through. The ratio of the axial length of an orifice to its cross-sectional diameter helps determine its spray characteristics. Generally, a relatively shorter length orifice produces a bushier fuel spray having a relatively lower penetration capability through air in a combustion chamber compared to a relatively longer length orifice of the same cross-sectional area. Sac-type tips generally produce well-atomized fuel sprays or plumes which effectively disperse fuel over a wide region to facilitate good mixing with air present in the engine combustion chamber.

However, sac-type tips are becoming undesirable for currently-produced engines because such tips help produce particulates that may prevent the engines from meeting current and/or future stringent emissions standards. The main culprit is existence of the relatively large volume sac which contains fuel after the check has seated on the tip seat to end injection. Such fuel remaining in the sac, after the check is seated, may continue flowing at a reduced pressure towards the uncovered entrances of each orifice due to fluid momentum and/or thermal expansion caused by heat transfer from the engine combustion chamber. Such fuel may dribble out of the orifices and into the engine combustion chamber as an non-atomized fuel stream at an undesirable time in the engine cycle resulting in particulate emissions.

Another category of such nozzle assemblies, known as valve-closed-orifice (VCO) nozzle assemblies, generally describes a tip configuration in which the upstream entrance of each orifice either i) intersects the tip seat or ii) is located downstream of the tip seat but is adjacent to or in close proximity to the tip seat. Another definition of a VCO nozzle assembly is that the combined exposed cross-sectional flow areas at the upstream entrance to each orifice in the tip is either i) zero when the check is seated on the tip seat or ii) is at least less than the combined exposed cross-sectional flow areas at the upstream entrance to each orifice when the check is unseated from the tip seat. Typically, the upstream entrance to each orifice is entirely or at least partially covered by the check when the check is seated on the tip seat. Examples of known VCO nozzle assemblies are shown in U.S. Pat. No. 4,083,498 issued to Cavanagh et al. on Apr. 11, 1978, U.S. Pat. No. 4,540,126 issued to Yoneda et al. on Sep. 10, 1985, and U.S. Pat. No. 4,715,541 issued to Freudenschuss et al. on Dec. 29, 1987.

VCO nozzle assemblies have certain advantages over sac-type nozzle assemblies which make the former desirable for helping currently produced engines meet stringent emission standards. First, the location of the orifices in a VCO tip eliminates the need for a sac to accommodate such orifices and the fuel flowpath thereto. Elimination of the sac minimizes the amount of fuel remaining in the tip downstream or below the check after the check has seated on the tip seat. Moreover, after injection has ended and the check becomes seated on the tip seat, any fuel remaining in the tip downstream of the check is prevented or at least inhibited from simply dribbling into the engine combustion chamber since the upstream entrance of each orifice is either covered or at least partially covered by the seated check.

A problem with VCO nozzle assemblies has been that the relatively closer proximity of the orifices to the tip seat has been traditionally thought to produce a significantly high stress concentration factor in that region. The conventional approach to coping with such perceived high stress has been to increase the wall thickness of the VCO tip in that region.

The minimum allowable VCO tip wall thickness has been traditionally determined with the aid of a stress concentration curve plotting stress concentration factor, $k_c$, as a function of orifice angle, theta. As shown in FIG. 4, orifice angle means the included angle between the tip seat and the centerline axis of the respective orifice. A previously known stress concentration curve is labeled as curve $k_{c1}$ in FIG. 3. This curve was generated by a simple three-dimensional analysis.

For example, some engine cylinder head configurations having a fuel injector, one exhaust valve and one air intake valve require that the fuel injector to be installed at an angle, relative to the piston centerline axis, with the orifices positioned in the tip in an oblique pattern relative to the piston centerline. In other words, the orifice angles must be made less than 90°. As the orifice angle theta decreases, the previously known $k_{c1}$ curve of FIG. 3 predicts a higher stress concentration factor in the region of the tip seat/orifice intersection. Traditionally, the wall thickness of the VCO tip in this region has been increased to a thickness far in excess of the above-mentioned typical wall thicknesses for the sac of a sac-type tip. For example, as stated in U.S. Pat. No. 5,016,820 issued to Gaskell on May 21, 1991 and U.S. Pat. No. 5,092,039 issued to Gaskell on Mar. 3, 1992, there is a strict limit to how far the wall thickness of a nozzle can be reduced in the case of VCO nozzles, on grounds of strength; with the high injection pressures involved, there is a danger of the tip of the nozzle being blown off if it is of inadequate strength. Gaskell says in practice the wall thickness must be 1 mm (0.0394 inches) or at the very least 0.8 mm (0.315 inches). The preceding statement and FIG. 1 of Gaskell suggests that the above stated 0.8 mm minimum wall thickness is for an orifice angle, theta, of 90°. For orifice angles theta less than 90° one of ordinary skill in the art traditionally concludes that the corresponding minimum wall thickness should be greater than the 0.8 mm wall thickness indicated for theta equal to 90°.

One disadvantage of such relatively thick walled VCO tips is the increased cost of forming orifices through such tips. Another disadvantage is that the relatively thick wall of a VCO tip may produce poor fuel spray characteristics which undesirably result in higher emissions. The reason for higher emissions is that a relatively thick walled VCO tip consequently results in a relatively longer orifice length such that the orifice acts somewhat like a long-barreled rifle when injecting fuel. During fuel injection, the fuel exiting the long orifice remains as a relatively concentrated fuel stream instead of sufficiently atomizing and mixing with the air present in an engine combustion chamber. In relatively small engine combustion chambers, such concentrated fuel streams may undesirably impinge on the piston or cylinder bore resulting in emissions.

The present invention is directed to overcoming one or more of the problems as set forth above.

DISCLOSURE OF THE INVENTION

In one aspect of the present invention a valve-closed-orifice spray tip is disclosed. The tip has a wall portion defining an internal tip seat and at least one fuel spray orifice. The wall portion of the tip has a thickness less than 1.2 mm (0.047 inches).

In another aspect of the present invention a valve-closed-orifice spray tip is disclosed. The tip defines an internal tip seat and at least one fuel spray orifice. The orifice has an axial length and an effective cross-sectional diameter wherein the ratio of the orifice length to the orifice diameter is less than 6.0.

Previously known valve-closed-orifice (VCO) tips have minimum wall thickness equal to or greater than 1.2 mm (0.047 inches). The embodiments herein disclosed provide VCO tips having high pressure capability yet relatively thinner wall thicknesses which improve injection spray characteristics and reduce manufacturing costs.

BEST MODE FOR CARRYING OUT THE INVENTION

Figure 1:
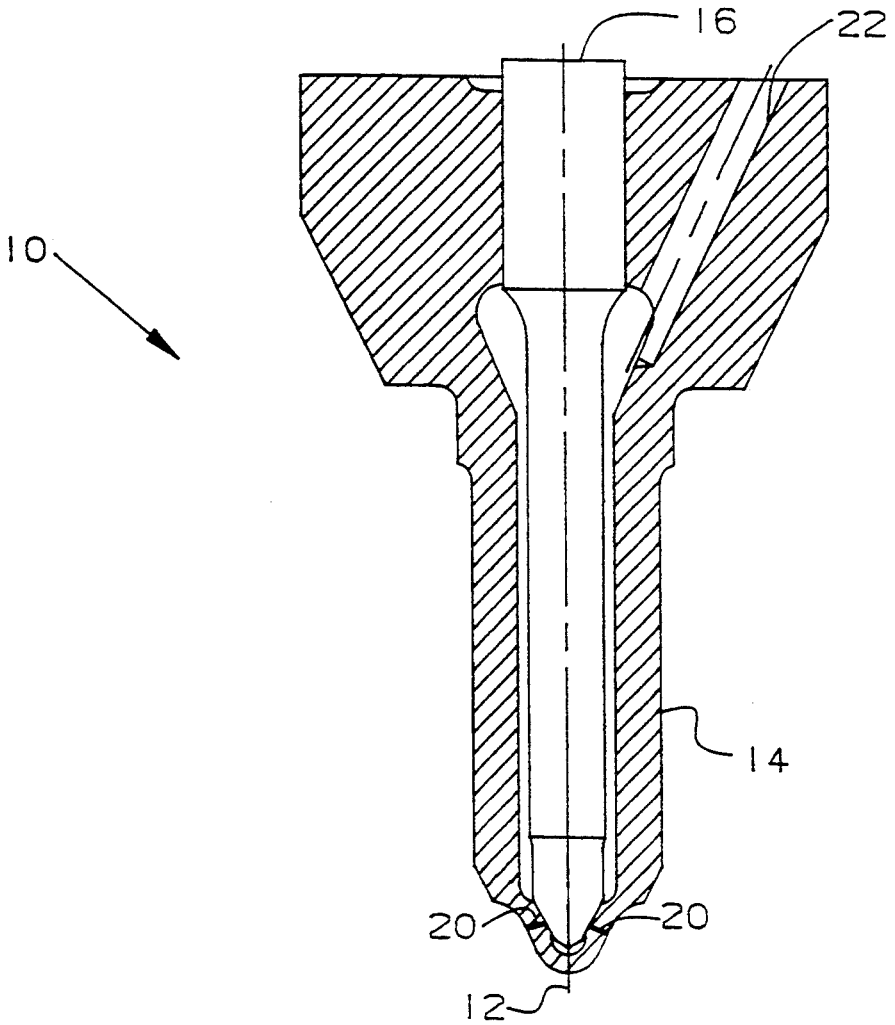
FIG. 1 is a diagrammatic cross-sectional view of one embodiment of the present invention.

Referring to the FIGS. 1–8, wherein similar reference characters designate similar elements or features throughout these Figures, there is shown an embodiment of a closed type inwardly-opening fuel injection nozzle assembly 10. The nozzle assembly 10 is a valve-closed-orifice (VCO) nozzle assembly which preferably includes a longitudinal axis 12, a hollow spray tip 14 or housing and a movable needle check 16 positioned in a blind bore of the tip 14.

Figure 2:
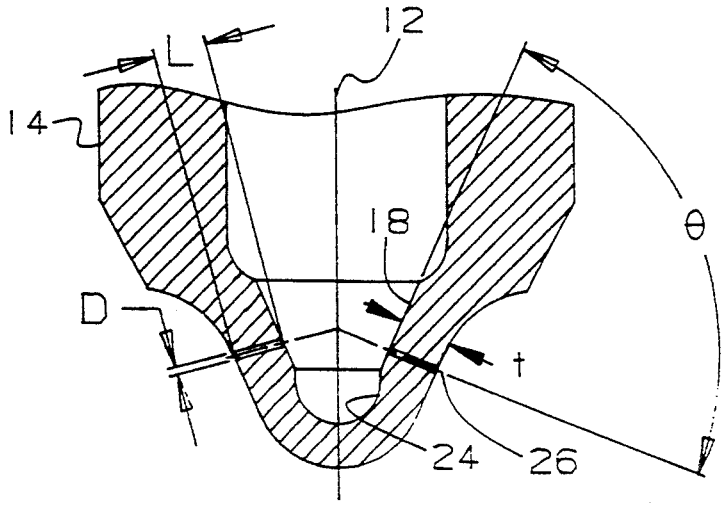
FIG. 2 is an diagrammatic enlarged partial view of the lower end portion of only the VCO spray tip shown in FIG. 1.

As shown in FIG. 2, the tip 14 includes a wall portion defining an internal tip seat 18 and one or more spray orifices 20. The tip 14 further includes one or more high pressure fuel passages 22 adapted to communicate with a source of high pressure fuel (not shown). Preferably, the tip seat 18 is conically or frusto-conically shaped. The tip 14 may also include a relatively small relief or space 24 formed in the internal apex of the tip 14 to facilitate formation of the tip seat 18 by, for example, a conventional grinding process.

The orifices 20 are shaped, sized and oriented according to particular engine performance requirements and packaging constraints. Preferably, the orifices 20 are cylindrically-shaped passages. In the embodiment shown, the orifices 20 are located downstream of the tip seat 18 and adjacent thereto (or nearly adjacent thereto). Alternatively, the orifices 20 may be arranged such that the upstream entrance of each orifice 20 directly intersects the tip seat 18. Preferably, the upstream entrance of each orifice 20 is radiused to blend with the intersecting surface of the tip seat 18 in order to improve nozzle flow and spray characteristics.

Contrary to conventional thinking in the fuel injection industry, Applicants have discovered that it is feasible to make a relatively thin-walled VCO tip having adequate pressure capability.

Figure 5:
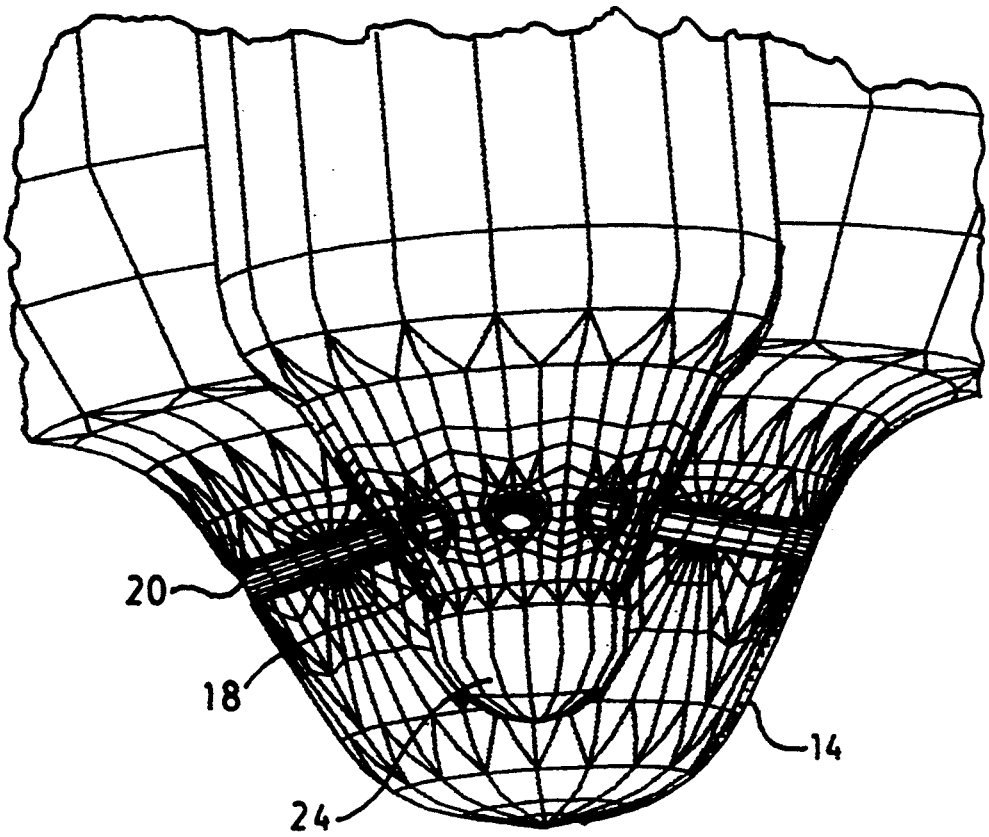
FIG. 5 is an diagrammatic enlarged view similar to FIG. 2 but illustrating a typical stress distribution in a cross-sectioned VCO spray tip as determined by Applicants' three-dimensional boundary element analysis.
Figure 6:
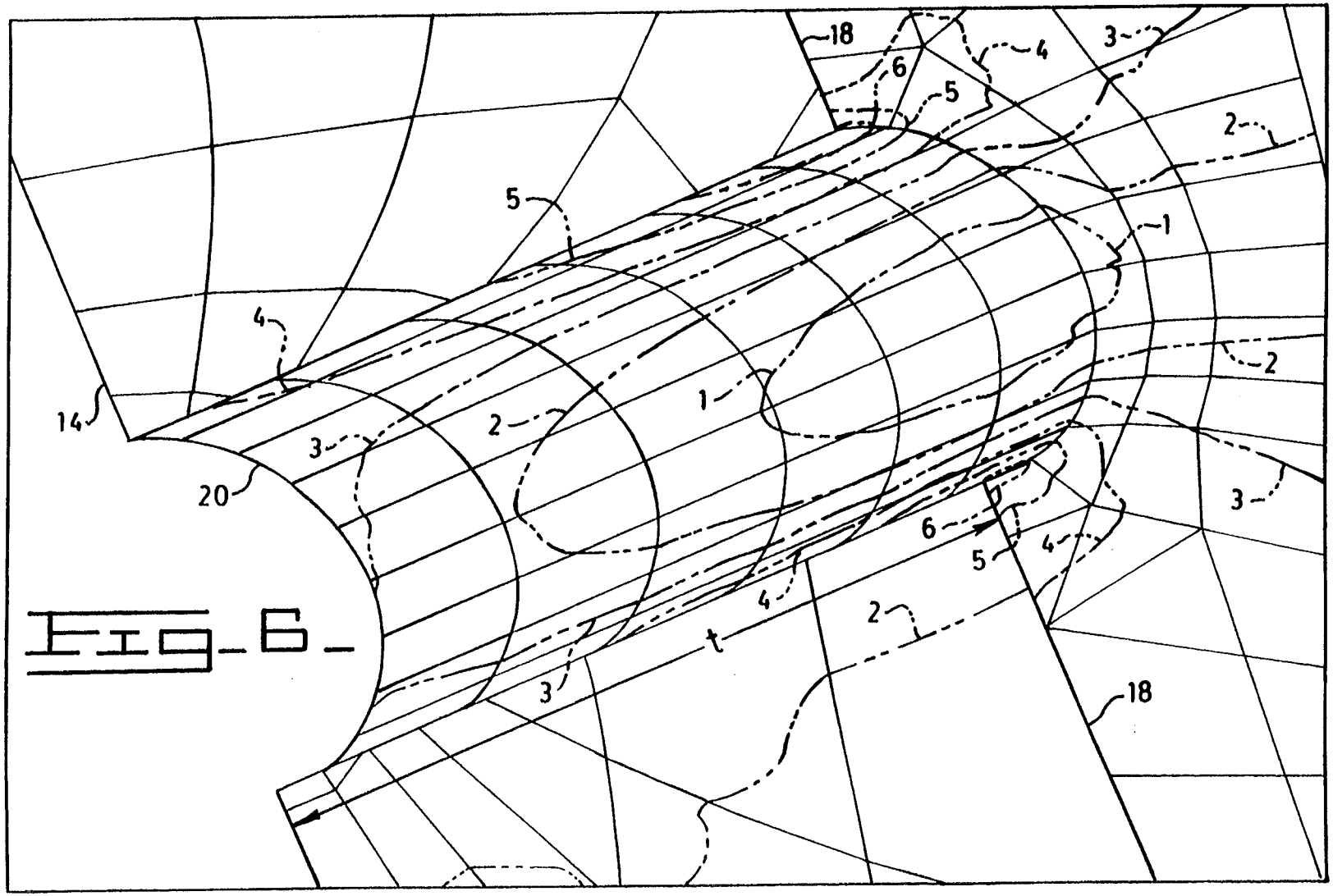
FIG. 6 is an enlarged partial view of FIG. 5 showing portions of an orifice and tip seat. The view of FIG. 6 has been rotated relative to FIG. 5 for clarity.

FIGS. 5 and 6 show the typical stress distribution around each sharp edge hole orifice 20 and the tip seat 18 as determined by Applicants. Applicants determined the distribution by performing three-dimensional boundary element analysis. Such analysis may be performed with the aid of any one of a number of boundary element analysis computer software programs that are presently commercially available. Applicants performed such analysis using a software program known as EZBEA (Easy Boundary Element Analysis) which is owned by Caterpillar Inc..

For the exemplary VCO tip 14 illustrated in FIG. 6, the injection pressure equaled 140 MPa or mega pascals (20,300 psi or pounds per square inch), the orifice angle theta equaled 75°, the orifice diameter D equaled 0.270 mm (0.011 inches), and the thickness t of the tip wall portion equaled 1.0 mm (0.039 inches). The contour lines of FIG. 6 represent the distribution of stress in the tip 14. The contour line represented by reference numeral 1 represents a tensile stress of about 38 MPa (5,511 psi). The contour line represented by reference numeral 2 represents a tensile stress of about 147 MPa (21,320 psi). The contour line represented by reference numeral 3 represents a tensile stress of about 255 MPa (36,983 psi). The contour line represented by reference numeral 4 represents a tensile stress of about 364 MPa (52,792 psi). The contour line represented by reference numeral 5 represents a tensile stress of about 473 MPa (68,600 psi). The contour line represented by reference numeral 6 represents a tensile stress of about 582 MPa (84,409 psi). A maximum tensile stress of about 690 MPa (100,073 psi) occurs at the intersection of the orifice 20 and tip seat 18.

Figure 3:
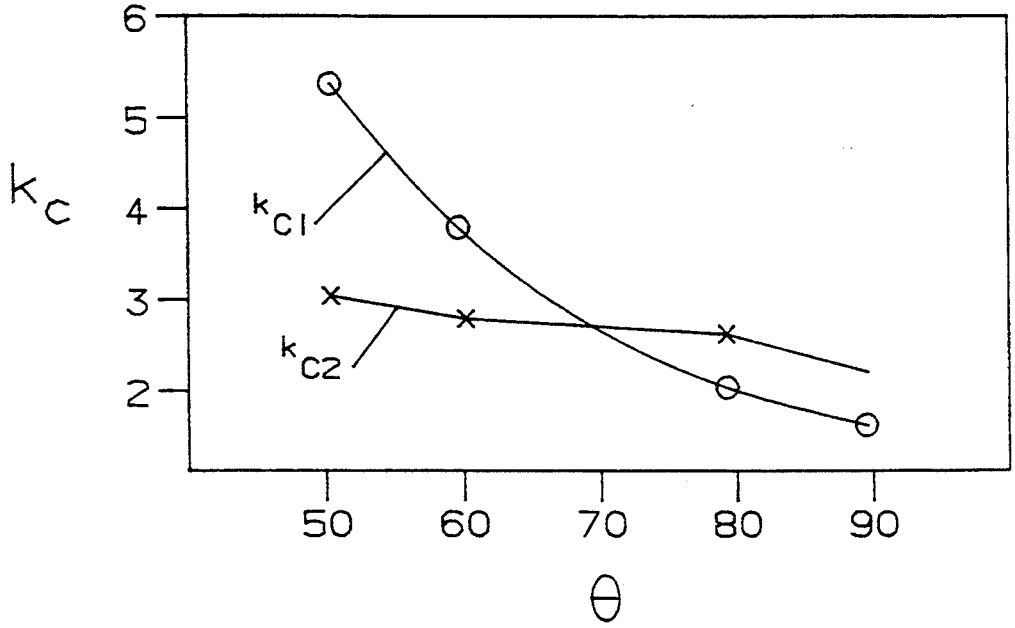
FIG. 3 is an diagrammatic graph which approximately shows stress concentration factor, $k_c$, versus orifice angle, theta measured in degrees, of a VCO tip according to Applicants' three-dimensional boundary element analysis and also according to a previously known analysis.

Results of Applicants' three-dimensional boundary element analysis are plotted as curve $k_{c2}$ in FIG. 3 in terms of stress concentration factor ($k_c$) versus orifice angle (theta) for a given location of the orifice 20 relative to the tip seat 18. Curve $k_{c1}$ in FIG. 3 shows the above relationship according to a previously known but relatively simple three-dimensional analysis. Applicants discovered that the previously known stress concentration factors are nearly the same as Applicants' three-dimensional boundary element stress concentration factors if the orifice 20 is oriented perpendicular to the tip seat 18, but differ for orifice angles less than 90°. As orifice angle decreases, Applicants' three-dimensional boundary element analysis stress concentration curve $k_{c2}$ does not rise as steeply as the previously known $k_{c1}$ stress concentration curve. For example, at an orifice angle of 60° degrees, stresses are about twenty-five percent lower with Applicants' three-dimensional boundary element analysis than that predicted with the previously known analysis. Thus, comparing Applicants' three-dimensional boundary element analysis to the previously known analysis, the tip wall can be made much thinner for orifice angles smaller than 90°.

Figure 4:
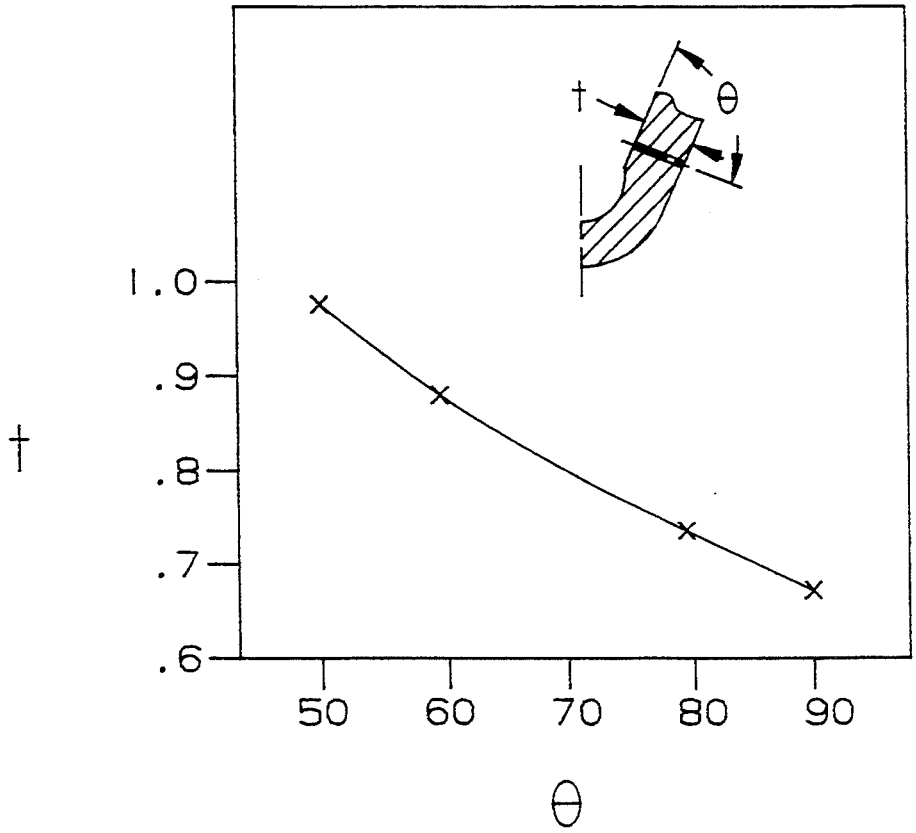
FIG. 4 is an diagrammatic graph which approximately shows minimum wall thickness, t measured in millimeters, of a VCO spray tip versus orifice angle, theta measured in degrees, according to Applicant's three-dimensional boundary element analysis.

FIG. 4 is an diagrammatic graph which approximately shows minimum wall thickness, t, of a VCO spray tip 14 versus orifice angle, theta, according to Applicant's three-dimensional boundary element analysis. This analysis was made for a VCO tip 14 operating at about 140 MPa (about 20,300 psi) rated injection pressure and a factor of safety of 1.7. The injection pressure capability can be increased if the factor of safety is reduced. It can be seen that the wall thickness of Applicants' VCO tip 14 can be made much thinner than previously known VCO tips which have a minimum wall thickness equal to or greater than 1.2 mm (0.047 inches).

Figure 7:
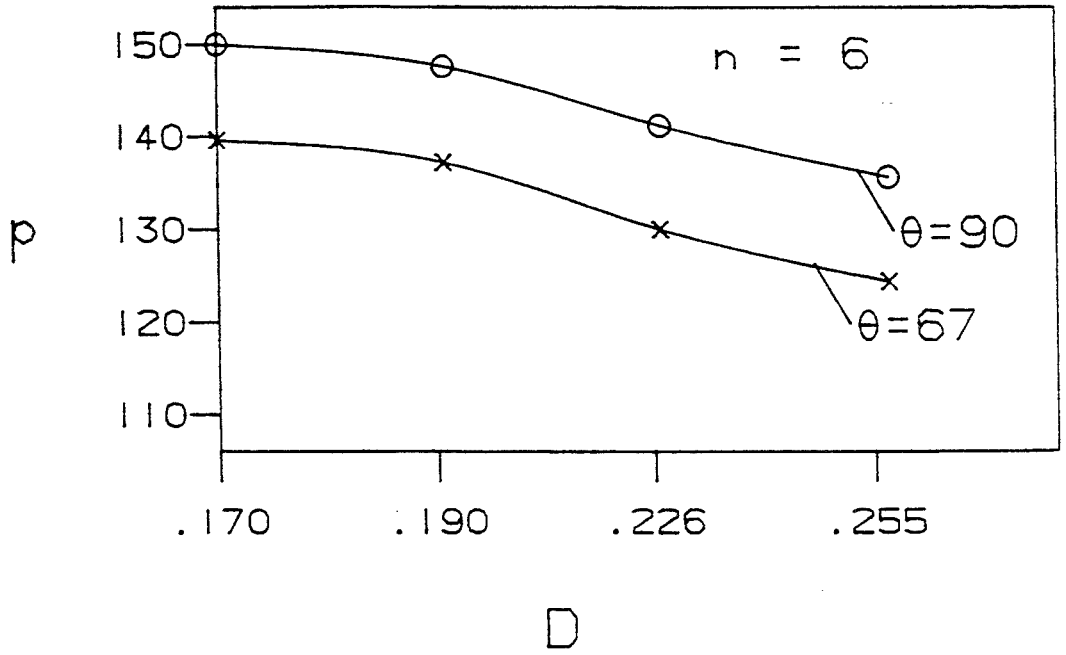
FIG. 7 is an diagrammatic graph which approximately shows fuel injection pressure capability, P measured in mega pascals, versus orifice diameter, D measured in millimeters, for two different orifice angles, theta measured in degrees, according to Applicants' three-dimensional boundary element analysis. In this graph, the total number of orifices in the VCO tip equals six.
Figure 8:
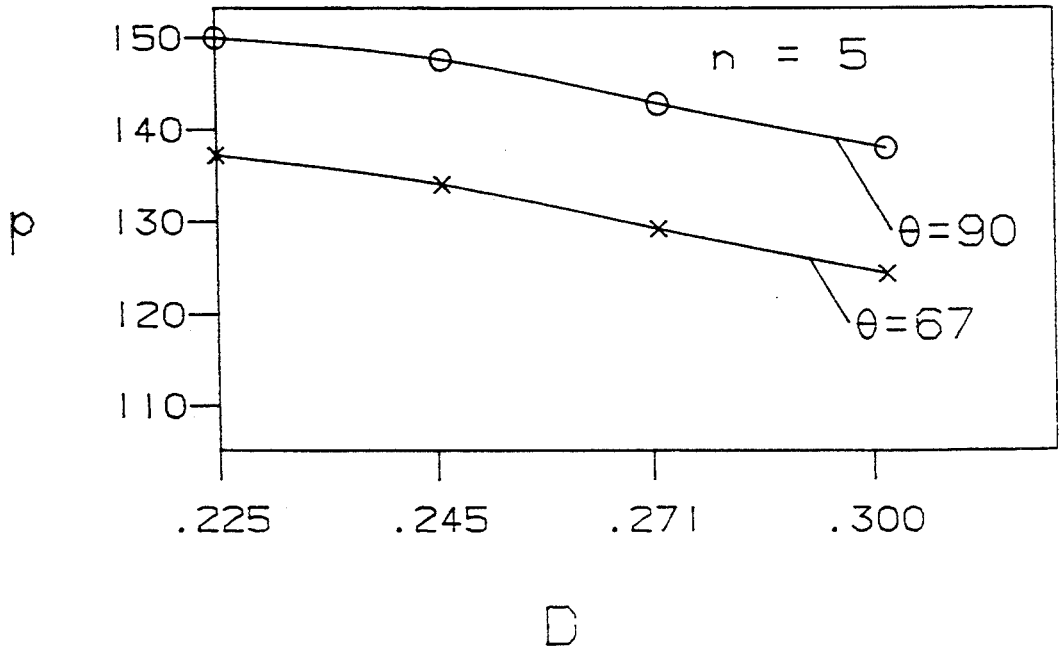
FIG. 8 is an diagrammatic graph similar to FIG. 7 but wherein the total number of orifices in the VCO tip equals five.

The effect of orifice diameter (D) on injection pressure capability of the tip 14 is shown in FIGS. 7 and 8. Allowable injection pressures P for a tip 14 achieving infinite fatigue life are shown for such tips having six and five orifices, respectively. The allowable injection pressure P would be higher if less than infinite fatigue life is desired. As shown by FIGS. 7 and 8, decreasing the orifice diameter D tends to increase the injection pressure capability P of the tip 14. Moreover, decreasing the orifice angle theta tends to decrease the injection pressure capability P of the tip 14. There appears to be little difference in injection pressure capability P between the tip having six orifices (FIG. 7) and the tip having five orifices (FIG. 8) for the particular location of the orifices herein analyzed. Generally, an increasing number of orifices would probably lessen the tip's injection pressure capability as the orifices are located closer and closer to the apex of the tip 14 since the orifices would be less and less mutually spaced apart.

Testing of the tip 14 at elevated injection pressures has validated Applicants' three-dimensional boundary element analysis and the viability of a thin-walled VCO tip 14. Referring to FIG. 2, each orifice 20 has a centerline axis 26 oriented at an orifice angle, theta, relative to the tip seat 18. The orifice angle theta is less than or equal to 90°. For certain engine applications, the orifice angle theta preferably ranges from about 85° to about 65°. Depending on the engine application, the orifice angle theta may be the same or vary from orifice to orifice on a multi-orificed tip 14.

Moreover, each orifice 20 has a predetermined length, L, measured parallel to the orifice axis 26. For certain engine applications, the length L is preferably in the range of about 0.90 to 1.1 mm (about 0.035 to 0.043 inches). Depending on the engine application, the orifice length L may be the same or vary from orifice to orifice on a multi-orificed tip 14.

Each orifice 20 also has an effective cross-sectional diameter, D, measured perpendicular to the orifice centerline axis 26. Preferably, the diameter D is in the range of about 0.163 to 0.330 mm (about 0.006 to 0.013 inches). Depending on the engine application, the orifice diameter D may be the same or vary from orifice to orifice on a multi-orificed tip 14. The minimum diameter D is preferably sized to be at least larger than the smallest debris or particles that fuel filters, located upstream of the orifices 20, will pass. This helps avoid plugging of the orifices 20 with such debris. The maximum orifice diameter D depends upon the desired fuel spray characteristics and injection pressure level.

Preferably, the ratio of the orifice length L to respective orifice diameter D is less than 6.0 and equal to or greater than about 4.5.

Each orifice 20 has an upstream entrance defining a cross-sectional flow area. For relatively small engine applications, the combined flow areas for all the orifice entrances is preferably less than about 0.190 $mm^2$ (about 0.0003 $inches^2$).

The tip 14 has a minimum thickness, t, in the wall portion encompassing the tip seat 18 and orifices 20. The thickness t is measured perpendicular to the tip seat 18. The thickness of the wall portion is less than 1.2 mm (0.047 inches). Preferably, the thickness t of the wall portion is in the range of about 0.68 to 1.1 mm (about 0.027 to 0.043 inches) when the orifice angle theta is about 90° and the desired fuel injection pressure capability is at least about 120 MPa (17,400 psi) at a factor of safety of 1.7. Preferably, the thickness t of the wall portion is in the range of about 0.90 to 1.1 mm (about 0.035 to 0.043 inches) when the orifice angle theta is in the range of about 65° to 90° and the desired fuel injection pressure capability is at least about 120 MPa (17,400 psi) at a factor of safety of 1.7.

INDUSTRIAL APPLICABILITY

The VCO tip 14 may be adapted for nozzle assemblies used on a wide variety of fuel injection systems. For example, the tip 14 may be adapted for unit pump-injectors of the general type, for example, shown in U.S. Pat. No. 4,527,738 issued to Martin on Jul. 9, 1985 or U.S. Pat. No. 5,121,730 issued to Ausman et al. on Jun. 16, 1992. The tip 14 may also be adapted for injectors used in pump-line-nozzle fuel systems generally of the type shown, for example, in U.S. Pat. No. 4,765,543 issued to Jaksa et al. on Aug. 23, 1988.

Referring to FIG. 1, the check 16 is movable between a first position where the check 16 is seated on the tip seat 18 and a second position where the check 16 is unseated or spaced from the tip seat 18. At the first position, the check 16 blocks communication of high pressure fuel or fluid from the passage(s) 22 to the orifice(s) 20. Moreover, at the first position, the check either completely or at least partially covers the orifice upstream entrances. At the second position, the check 16 opens communication of high pressure fuel or fluid from the passage(s) 22 to the orifice(s) 20.

The VCO tip 14 is advantageous over sac-type tips due to the elimination of a sac to accommodate orifices and the fuel flowpath thereto. Elimination of the sac minimizes the amount of fuel remaining in the tip downstream or below the check after the check has seated on the tip seat. Moreover, after injection has ended and the check becomes seated on the tip seat, any fuel remaining in the tip downstream of the check is prevented or at least inhibited from simply dribbling into the engine combustion chamber since the upstream entrance of each orifice is either covered or at least partially covered by the seated check.

The relatively thin-walled VCO tip 14 is advantageous over previously known VCO tips, having relatively thicker walls, since the cost of forming orifices through the tip 14 is reduced.

Another advantage over previously known VCO tips is that the relatively thin-walled VCO tip 14 produces better fuel spray characteristics which result in lower particulate emissions for a given $NO_x$ emission level. The relatively thin walled VCO tip defines a relatively shorter orifice length (L) such that, for a given orifice diameter (D), fuel exiting the orifice 20 is more effectively dispersed as a well-atomized plume thereby facilitating better mixing with the air present in the engine combustion chamber. In relatively small engine combustion chambers, such fuel spray characteristics help avoid impingement of the fuel spray on the piston or cylinder bore thereby avoiding such resultant emissions. The thickness (t) of the wall portion of the VCO tip 14 may be made relatively thinner than previously known VCO tips when decreasing the orifice angle below 90°. Alternatively stated, the orifice angles of the VCO tip 14 can be made relatively smaller than previously known VCO tips while achieving desired fuel injection spray characteristics and injection pressure capability. The ability to vary the orifice angles of the VCO tip 14 over a wide range equal to or less than 90° gives the VCO tip 14 more flexibility in meeting engine performance and packaging requirements.

The following are examples of VCO tips made as a result of Applicants' subject invention. Tip #1 has a wall thickness t of 0.90 mm (0.035 inches), a total of six orifices, L/D ratios ranging from about 4.6 to 5.8, orifice angles theta ranging from about 75° to 81° and a fuel injection pressure capability P (for infinite fatigue life) of about 140 MPa (20,300 psi) and a factor of safety of 1.7:

| | |
|---|---|
| first and second orifices | |
| orifice angle, theta: | 75° |
| orifice length, L: | 1.035 mm |
| orifice diameter, D: | 0.225 mm |
| L/D ratio: | 4.6 |

-continued

| | |
|---|---|
| third and fourth orifices | |
| orifice angle, theta: | 82° |
| orifice length, L: | 1.010 mm |
| orifice diameter, D: | 0.174 mm |
| L/D ratio: | 5.8 |
| fifth and sixth orifices | |
| orifice angle, theta: | 78° |
| orifice length, L: | 1.021 mm |
| orifice diameter, D: | 0.200 mm |
| L/D ratio: | 5.1 |

Tip #2 has a wall thickness t of 0.90 mm (0.035 inches), a total of seven orifices, L/D ratios ranging from about 5.6 to 6.0, orifice angles theta ranging from about 82° to 67°, and a fuel injection pressure capability P (for infinite fatigue life) of about 140 MPa (about 20,300 psi) and a factor of safety of 1.7:

| | |
|---|---|
| first orifice | |
| orifice angle, theta: | 75° |
| orifice length, L: | 0.93 mm |
| orifice diameter, D: | 0.163 mm |
| L/D ratio: | 5.7 |
| second orifice | |
| orifice angle, theta: | 71° |
| orifice length, L: | 0.95 mm |
| orifice diameter, D: | 0.163 mm |
| L/D ratio: | 5.8 |
| third orifice | |
| orifice angle, theta: | 81° |
| orifice length, L: | 0.91 mm |
| orifice diameter, D: | 0.163 mm |
| L/D ratio: | 5.6 |
| fourth orifice | |
| orifice angle, theta: | 79° |
| orifice length, L: | 0.92 mm |
| orifice diameter, D: | 0.163 mm |
| L/D ratio: | 5.6 |
| fifth orifice | |
| orifice angle, theta: | 68° |
| orifice length, L: | 0.97 mm |
| orifice diameter, D: | 0.163 mm |
| L/D ratio: | 6.0 |
| sixth orifice | |
| orifice angle, theta: | 82° |
| orifice length, L: | 0.91 mm |
| orifice diameter, D: | 0.163 mm |
| L/D ratio: | 5.6 |
| seventh orifice | |
| orifice angle, theta: | 67° |
| orifice length, L: | 0.98 mm |
| orifice diameter, D: | 0.163 mm |
| L/D ratio: | 6.0 |

Other aspects, objects, and advantages of this invention can be obtained from a study of the drawings, the disclosure, and the appended claims.

We claim:

1. A valve-closed orifice spray tip adapted for a fuel injection nozzle assembly wherein said assembly includes a movable check positioned in the tip, said tip having a wall portion defining an internal tip seat and at least one fuel spray orifice having an upstream entrance, said check movable between a first position at which the check is adapted to be seated on the tip seat and at least partially covering said at least one orifice upstream entrance and a second position at which the check is adapted to be unseated from the tip seat so that said at least one orifice upstream entrance is uncovered by the check, said at least one fuel spray orifice having an axis defining an orifice angle relative to the tip seat, said wall portion having a thickness of at least 0.68 mm (0.0267 inches) but less than 0.8 mm (0.0315 inches) when said orifice angle is equal to 90°.

2. A valve-closed-orifice spray tip adapted for a closed type inwardly-opening fuel injection nozzle assembly including a movable check positioned in the tip, said tip having a wall portion defining an internal tip seat and at least one fuel spray orifice, said wall portion having a thickness in the range of 0.68 mm to less than 0.8 mm (0.027 inches to less than 0.0315 inches), said at least one orifice having a centerline axis and an effective cross-sectional diameter in the range of 0.163 mm to 0.330 mm (0.006 inches to 0.013 inches), said axis and the tip seat defining therebetween an orifice angle equal to 90°.

* * * * *